United States Patent [19]

Buchanan, Jr.

[11] Patent Number: 4,959,939

[45] Date of Patent: Oct. 2, 1990

[54] BUILDING PANEL MOUNTING SYSTEM

[75] Inventor: Robert H. Buchanan, Jr., Canton, Mich.

[73] Assignee: National Steel Corporation, Pittsburgh, Pa.

[21] Appl. No.: 412,519

[22] Filed: Sep. 26, 1989

[51] Int. Cl.[5] ..... E04D 1/36

[52] U.S. Cl. ..... 52/462; 52/466; 52/469

[58] Field of Search ..... 52/461, 462, 463, 464, 52/520, 521, 465, 469

[56] References Cited

U.S. PATENT DOCUMENTS

| | | | |
|---|---|---|---|
| 511,386 | 12/1893 | White | 52/462 |
| 1,147,582 | 7/1915 | Von Uffel | 52/462 |
| 1,724,601 | 8/1929 | Kellogg | 52/467 |
| 2,358,733 | 9/1944 | Overly | 52/461 |
| 3,063,201 | 11/1962 | Rylander | 52/470 |

FOREIGN PATENT DOCUMENTS

| | | | |
|---|---|---|---|
| 2913060 | 10/1980 | Fed. Rep. of Germany | 52/463 |
| 1401196 | 4/1965 | France | 52/463 |

*Primary Examiner*—John E. Murtagh

*Attorney, Agent, or Firm*—James L. Bean

[57] ABSTRACT

A wall panel assembly for an external building roof or wall including a plurality of generally rectangular sheet metal panels each including a longitudinally extending outwardly projecting reinforcing rib adjacent each longitudinal side edge and at least one such rib intermediate said longitudinal side edges with the panels being disposed in parallel relationship with the reinforcing ribs on adjacent side edges of successive panels overlapping and secured to underlying structure by a plurality of headed fasteners penetrating each said panel along each reinforcing rib has the fastener heads concealed by batten strips mounted by clips which are secured to each reinforcing rib by the headed fasteners.

11 Claims, 2 Drawing Sheets

BUILDING PANEL MOUNTING SYSTEM

BACKGROUND OF THE INVENTION

1. Field of the Invention

This invention relates to metal roofing and siding panel mounting systems, and more particularly to such a mounting system employing panel penetrating fasteners for securing both the overlapping side edges of adjacent panels and the central portions of individual panels to underlying support structure.

2. Description of the Prior Art

Metal building panels of the type employed for the construction of external building walls and roofs are conventionally relatively large to minimize the number of side and end joints in the completed wall or roof. Such roof and wall panels, herein referred to as building panels or panels, may be up to 30 feet or more in length and 38 inches or more in overall width and are mounted to underlying support members such as roofing purlins or wall girts (hereinafter purlins) by suitable penetrating fasteners such as ring shank or screw shank nails or drill screws with sealing washers. Such building panels are conventionally formed with longitudinally extending ribs for strength and decorative purposes, one such building panel being illustrated, for example, in U.S. Pat. No. 205,008.

The width of such conventional building panels may make it necessary to secure the individual panels to the underlying purlins at points intermediate the panel edges as well as at the edge joints, and the heads of the penetrating fasteners are visible from the exterior of the building structure. Such exposed fastener heads detract from the building appearance, particularly if the color of the heads and insulating washer material does not identically match that of the building panels.

It has been proposed, for example in U.S. Pat. No. 4,321,780, to conceal the fastener heads used to mount metal building panels by providing the panels with an inwardly concave reinforcing rib through which the fasteners are driven. Each fastener is passed through a mounting clip which projects upwardly into the outwardly open reinforcing rib channel, and a shaped capping strip is releasably mounted on the mounting clips in outwardly spaced relation from the bottom of the rib channel. This arrangement, however, requires a different construction at the edges of adjacent panels so that a non-uniform appearance is given to the finished wall or roof. Further, when this arrangement is employed in a roofing assembly, water will inherently penetrate to the bottom of the reinforcing rib channel and, unless a tight seal is provided between the adjacent surfaces of the building panel and mounting clip, moisture can be drawn by capillary action to the fastener opening through the building panel and ultimately result in corrosion and/or leakage.

It is also well known to use elongated cap or batten strips to cover the edge joint between adjacent panels in a metal building panel roof or wall structure. U.S. Pat. No. 3,327,443 and U.S. Pat. No. 2,428,361 illustrate this type of construction. Such building panels, however, are normally relatively narrow and do not disclose any means for securing individual panels to the underlying purlins intermediate the panel edges. Further, such structures normally do not employ an overlapping type seam between adjacent building panels but rather provide some structure secured directly to the underlying purlin for anchoring the adjacent panel edges.

SUMMARY OF THE INVENTION

In order to overcome the deficiencies and drawbacks of the prior art building panel mounting systems, it is an object of the present invention to provide a mounting system employing fasteners which penetrate the building panel reinforcing ribs both at the edge joints and intermediate the joints to securely mount the panels on the underlying support structure.

Another object of the invention is to provide such a building panel mounting structure employing improved cap or mullion strips for effectively concealing the mounting fasteners and providing a uniform appearance for the panel edge and intermediate reinforcing ribs.

Another object of the invention is to provide such a building panel mounting system employing an improved mullion strip mounting clip which supports the mullion in spaced relation to the building panel whereby various ornamental mullion configurations may be employed.

Another object is to provide such a building panel mounting structure wherein the fastener concealing mullion strips are mounted in a manner so as to prevent siphoning of water to the top of the reinforcing ribs in a roofing structure.

In the attainment of the foregoing and other objects and advantages, an important feature of the present invention resides in the use of a plurality of resilient mullion strip supporting clips on the external surface of the building panels at spaced intervals along the reinforcing ribs. The retainer clips are of a generally inverted U-shaped configuration adapted to fit over and conform closely to the outer surface of the reinforcing ribs at their outwardly directed top portion. The legs of the clips extend in contacting relation with the ribs for a distance sufficient to assure accurate alignment then flare outwardly and terminate in an inwardly rolled edge spaced laterally from the sides of the rib and outwardly from the building panel outer surface. The clamps have a central opening for receiving a roofing nail or threaded roofing screw so that the fasteners used to mount the panels to the purlins firmly secure the respective clamps in position.

The mullion strips are also of generally U-shaped configuration in cross section with their edges curved inwardly and being adapted to snap over and closely conform to the outer surface of the curved edge portion of the legs of the outwardly flaring mounting clip and extend in spaced relation to the reinforcing ribs from points adjacent the base of the rib on each side so as to effectively conceal the mounting clips and fastener heads and to present a uniform appearance to the reinforcing ribs and panel joints. Since the mullion strips are spaced outwardly from the ribs, there is no tendency for water to be siphoned, or drawn by capillary action, to the top of the reinforcing ribs where leaking could occur in the event of an improper seal at a fastener. Also, since the mullion strips do not contact the building panel, various mullion configurations can be used to present the desired pleasing appearance. Further, since the same mullion strip is used both at the central reinforcing ribs and at the edge joints, a uniform appearance is presented across the full expanse of a roof or wall assembly.

BRIEF DESCRIPTION OF THE DRAWINGS

The foregoing and other features and advantages of the invention will be apparent from the detailed description contained hereinbelow, taken in conjunction with the drawings in which.

DESCRIPTION OF THE PREFERRED EMBODIMENT

Figure 1:
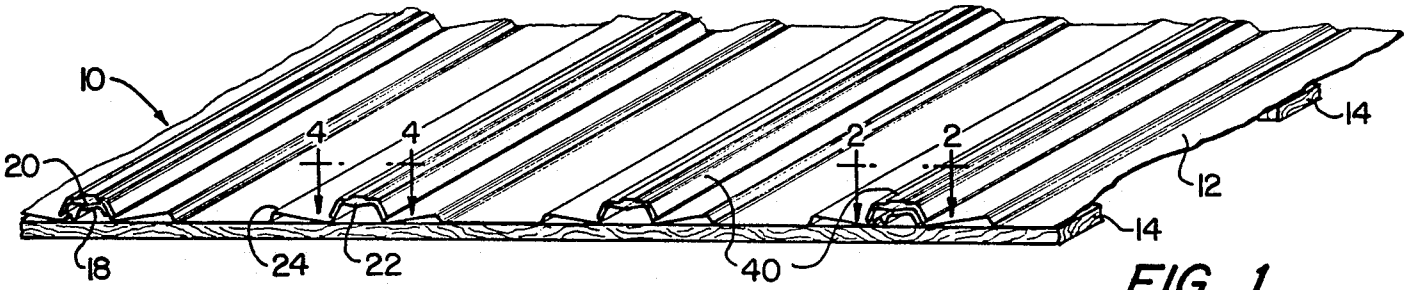
FIG. 1 is a fragmentary isometric view of a portion of a building wall or roof structure according to the present invention.

Referring now to the drawings in detail, a portion of an external wall or roof assembly embodying the present invention is designated generally by the reference numeral 10 and comprises a plurality of generally rectangular metal building panels 12 supported in generally edge-to-edge overlapping relation. The building panels 12 are secured to underlying roofing purlins or wall grits 14 by suitable panel penetrating fasteners 16. Each building panel 12 is formed with longitudinal reinforcing ribs 18, 20, one adjacent each side edge, with rib 18 being adapted to fit under and be overlapped by a rib 20 on an adjacent panel 12 in the completed assembly. In addition, one or more central, longitudinally extending reinforcing ribs 22 are provided between edge ribs 18, 20, and the panel portion between adjacent ribs may be contoured, as shown at 24 to further reinforce the panel against flexing and to provide a decorative effect.

The reinforcing ribs may be of any suitable profile such as a generally sinusoidal or V-shaped corrugation but preferably have a profile of the type illustrated in the drawings wherein ribs 20 and 22 include generally straight, upwardly inclined leg portions 26, 28 joined at the top by a generally flat or slightly outwardly concave crown 30. The reinforcing ribs 20 and 22 may be substantially identical but preferably the rib 18 has one leg portion formed with a rain trough indicated generally at 32. The configuration of the reinforcing ribs 18, 20 and 22 are conventional and are incorporated in commercially available metal building panels.

Roof and external wall construction employing commercial metal building panels of the type described conventionally employ headed fasteners such as ring shank or screw shank roofing nails or the threaded screw fastener 16 shown in the drawings. Such fasteners penetrate the panels at the top of the reinforcing ribs and are driven or turned into the underlying purlin 14. Fasteners of this type employ a sealing washer 34 of lead, neoprene or other suitable material to provide a watertight seal where the fastener shank has penetrated the metal panel. While such an arrangement is structurally sound and generally provides the necessary weathertight integrity for roofs and external building walls, the fastener heads are visible from the exterior of the building and present an undesirable aesthetic effect. Also, repeated stressing of the fasteners as a result of thermal cycling of the building panels can loosen the fasteners and result in leaking and corrosion around the openings made by the fasteners.

Figure 5:
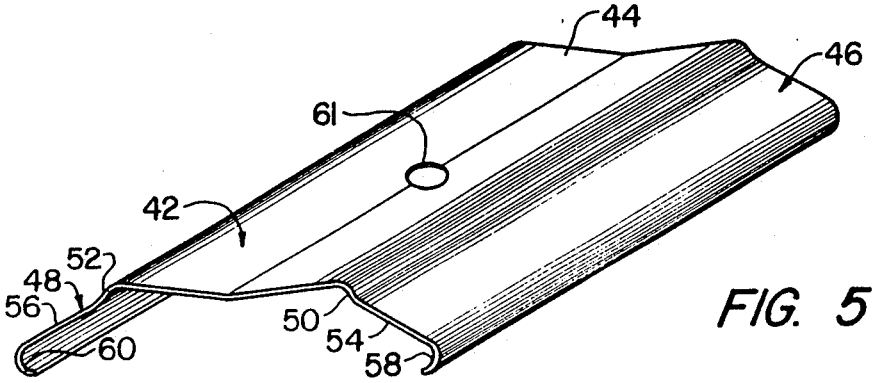
FIG. 5 is an isometric view of a mullion strip mounting clip employed in the invention.

The present invention provides an economical and easy means for concealing the fastener heads on metal building panel structures and simultaneously provides increased weathertight integrity for the building. This is accomplished by mounting an elongated cap or batten strip 40 over each panel reinforcing rib to conceal the heads of fasteners 32. Batten strips 40 are supported by a plurality of mounting clips 42 which, in turn, are firmly secured on the outwardly directed surface of the reinforcing ribs by the panel mounting fasteners. As best seen in FIG. 5, the clip 42 comprises a central body or web portion 44 having an inner surface complementary to and closely fitting over the outer surface of each reinforcing rib crown portion. A pair of outwardly and downwardly extending legs or flanges 46, 48 are integrally formed one on each edge of the central body 44 with flanges 46, 48 respectively, including an aligning portion 50, 52, respectively, engaging the outer surface of one panel rib leg adjacent the crown 30 for a distance sufficient to accurately align the mounting clip on the rib. Flanges 46, 48, respectively also include an outwardly flared spring arm portion 54, 56, respectively, extending in spaced relation to the reinforcing rib with arms 54, 56, respectively terminating in an inwardly turned generally arcuate edge or rim 58, 60.

The batten strip 40 is generally channel shaped and includes a central web portion 62 and a pair of outwardly diverging flange portions 64, 66 respectively terminating in an inwardly turned free edge or channel portion 68, 70 respectively. Before the batten members 40 are mounted on the building structure, the flanges 64, 66 have a maximum spacing which is less than the maximum spacing of the spring arms 54, 56 of the mounting clip 42.

Figure 2:
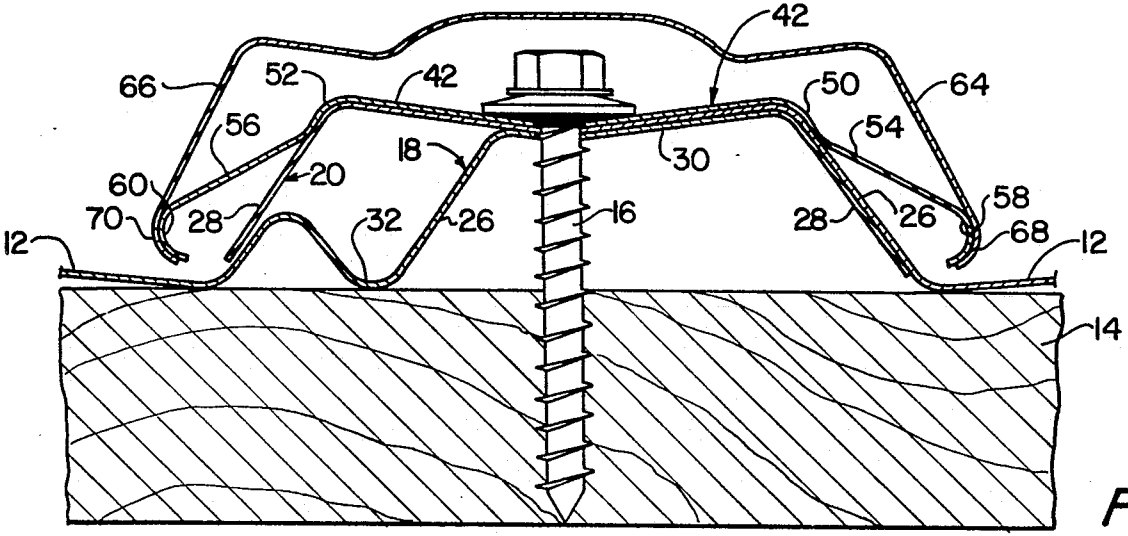
FIG. 2 is an enlarged fragmentary sectional view, taken on line 2—2 of FIG. 1.
Figure 4:
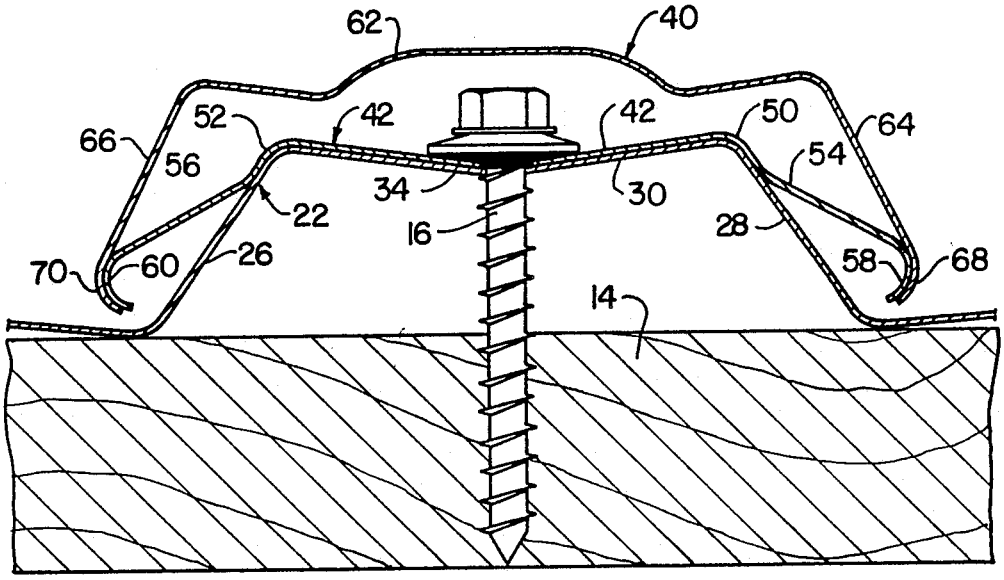
FIG. 4 is an enlarged fragmentary sectional view taken on line 4—4 of FIG. 1.

The central web 62 has a greater transverse dimension than the corresponding dimension of the central body or web 44 of clip 42, and the length of flanges 64, 66 are such that, when the batten strip 40 is installed on the mounting clips as shown in FIGS. 2 and 4, the inner surface of the crown is spaced from the mounting clip except in the area of channels 58, 60 which contact the outer surface of the inturned edges 58 and 60 of clip 42.

Figure 3:
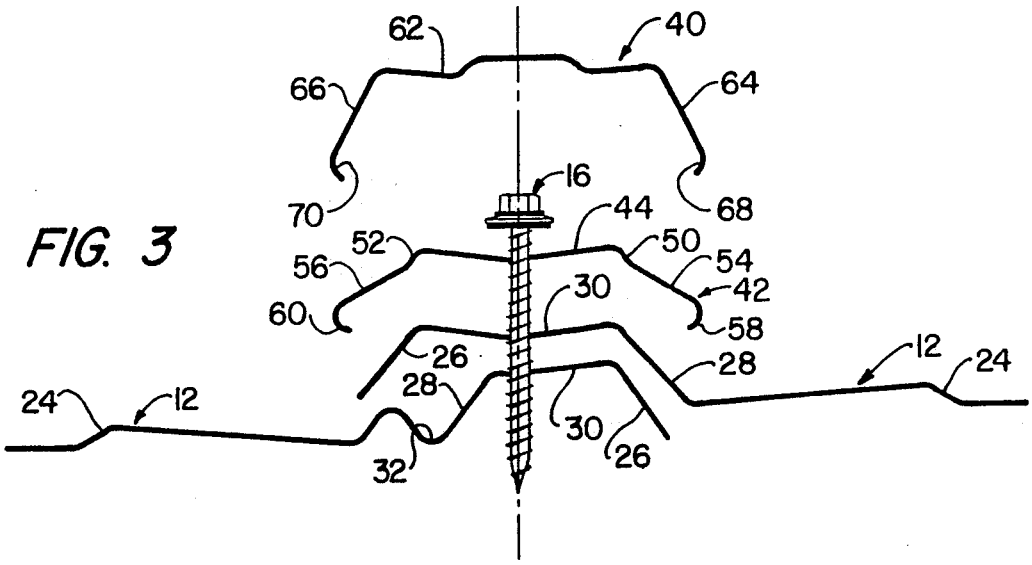
FIG. 3 is an exploded view of the structure shown in FIG. 2.

As is apparent from FIG. 3, the building panel system according to the present invention is mounted on an exterior surface of the building frame structure by inserting a fastener member 16 through the central opening 61 in clip 42, then driving the fastener through the top center of the building panel reinforcing rib and into an underlying purlin to draw the building panel into firm engagement with the purlin. In this position, the conventional sealing washer 34 beneath the head 35 of the fastener seals the opening 61 in the mounting clip 42 and may penetrate this opening around the shank of the fastener to seal the opening caused by penetration of the fastener through the building panel. Since the central body portion 44 of clip 42, and the adjacent aligning portions 50, 52 of flanges 46, 48 are complementary to the top outer surface of the reinforcing rib, each mounting clip will be firmly secured to the top of the rib with its curved rim portion longitudinally aligned with the reinforcing rib on which it is mounted. In this position, the flanges 46 and 48 of the clip are slightly spaced from the base portion of the reinforcing rib and the adjacent portion of the building panel as seen in the drawings. The batten strips 40 may then easily be installed by applying a downward force sufficient to cause the interlocking channel edges 68, 70 to snap over the rounded rims 58 and 60. In this position, the resilient force of the batten strip 40 and the mounting clip 42 retain the batten strips firmly mounted on the building panel, giving the appearance of the batten strips being an integral part of the building panels 12 while completely concealing the fastener heads and mounting clips.

As is apparent from FIGS. 2 and 4, the batten strips 40, when installed, are retained in outwardly spaced relation to the building panel reinforcing ribs, forming a generally arch-like, spaced cover for the ribs. This spaced relation completely eliminates any tendency of water to be drawn by capillary action or siphoning upwardly along the side edges of the reinforcing ribs when the building panels are used in a roofing structure. Further, the spring arm portions 54, 56 of mounting clips 42 also extend in spaced relation to the sidewalls of the reinforcing ribs throughout a major portion of the height of the ribs, again effectively eliminating the tendency of water to be siphoned upwardly to the top of the reinforcing ribs. Further, since the batten strips shield the reinforcing ribs and fasteners, watertight or weathertight integrity of a roof constructed in accordance with the invention is substantially enhanced. Also, the spacing of the batten strips from the building panels enables the use of different batten configurations to provide additional decorative effects for buildings employing the same basic building panel configuration.

While a preferred embodiment of the invention has been disclosed and described, it should be apparent that further embodiments may be employed. It is therefore not intended that the invention should be limited to the disclosed embodiment but rather it is intended to include all embodiments which would be apparent to one skilled in the art and which come within the spirit and scope of the invention.

What is claimed is:

1. A wall panel assembly for an external building roof or wall including a plurality of generally rectangular sheet metal panels each including a longitudinally extending outwardly projecting reinforcing rib adjacent each longitudinal side edge and at least one such rib intermediate said longitudinal side edges, said panels being disposed in parallel relationship with the reinforcing ribs on adjacent side edges of successive panels overlapping, a plurality of headed fasteners penetrating each said panel along each said reinforcing rib to secure the panels to underlying building structure, a plurality of batten strip mounting clips mounted on each said panel by said fasteners along each said reinforcing rib, and an elongated batten strip mounted on said clips and extending along each said reinforcing rib concealing said headed fasteners and said clips and improving the watertight integrity of the building wall, said reinforcing ribs being integrally formed from the building panel sheet metal and each including a pair of outwardly extending leg portions joined by a central web portion, said mounting clips each including a central body portion having a fastener receiving opening extending therethrough and shaped complementary to the exposed outer surface of the central web, and a pair of arms extending one along each edge of the body portion, said arms each including a first portion extending along and contacting the outer surface of the underlying reinforcing rib leg adjacent said central web and a second portion inclined outwardly from the reinforcing rib leg, said arms terminating in a free end spaced from the building panel and from the reinforcing rib, said batten members each including an elongated generally channel shaped member having a central crown and a pair of integrally formed, generally opposed, spaced flanges, said flanges terminating in an inwardly directed free edge portion forming a channel, said flange free edges being normally spaced apart a distance less than the spacing of said arm free ends and adapted to be snapped thereover whereby said batten strips may be mounted on the clips by asserting a compressive force deflecting the mounting clip arms inwardly to snap into interlocking relationship with the channel on the batten strip flanges.

2. The wall panel assembly defined in claim 1 wherein said free ends on said clip arms are curved inwardly to provide a smooth generally arcuate outer surface and wherein said channel on the free edge of said batten strip flanges are generally arcuate in cross section and complementary to and adapted to snap over and be retained by the arcuate surfaces on said clip arms.

3. The wall panel assembly defined in claim 1 wherein said batten strips are supported solely by said mounting clips, each said batten strip extending in outwardly spaced relation to the reinforcing rib over which it is mounted whereby when the wall panel assembly is employed as a roof, water is not siphoned upwardly along said reinforcing rib leg to said crown by capillary action between the reinforcing rib leg outer surface and the batten strip flange inner surface.

4. The wall panel assembly defined in claim 1 wherein said second portion of said mounting clip arms are spaced from said reinforcing rib legs when said batten strips are mounted thereon.

5. The wall panel assembly defined in claim 2 wherein said batten strips are supported solely by said mounting clips, each said batten strip extending in outwardly spaced relation to the reinforcing rib over which it is mounted whereby when the wall panel assembly is employed as a roof, water is not siphoned upwardly along said reinforcing rib leg to said crown by capillary action between the reinforcing rib leg outer surface and the batten strip flange inner surface, and wherein said second portion of said mounting clip arms are spaced from said reinforcing rib legs when said batten strips are mounted thereon.

6. In a wall panel assembly for an external building wall or roof including a plurality of generally rectangular sheet metal panels each including a longitudinally extending outwardly projecting reinforcing rib adjacent each longitudinal side edge and at least one such rib intermediate said longitudinal side edges, said panels being disposed in parallel relationship with the reinforcing ribs on adjacent side edges of successive panels overlapping, said reinforcing ribs being integrally formed from the building panel sheet metal and each including a pair of outwardly extending leg portions joined by a central web portion, and a plurality of headed fasteners penetrating each said reinforcing rib to secure the panels to underlying building structure, means for concealing the headed fasteners and improving the watertight integrity of the wall panel assembly comprising a plurality of batten strip mounting clips mounted on each said panel by said fasteners along each said reinforcing rib, and an elongated batten strip mounted on said clips and extending along each said reinforcing rib to thereby conceal said headed fasteners and said clips and improve the watertight integrity of the building wall, said mounting clips each including a central body portion having a fastener receiving opening extending therethrough and shaped complementary to the exposed outer surface of the central web, and a pair of arms extending one along each edge of the body portion, said arms each including a first portion extending along and contacting the outer surface of the underlying reinforcing rib leg adjacent said central web and a second portion inclined outwardly from the reinforcing rib leg, said arms terminating in a free edge spaced from the building panel and from the reinforcing rib, said batten members each including an elongated generally channel shaped member including a central crown and a pair of integrally formed, generally opposed, spaced flanges, said flanges terminating in an inwardly directed free edge forming a channel, said flange free edges being normally spaced apart a distance less than the spacing of said arm free ends and adapted to be snapped thereover whereby said batten strips may be mounted on the clips by asserting a compressive force deflecting the mounting clip arms inwardly to snap into interlocking relationship with the channel on the batten strip flanges.

7. The wall panel assembly defined in claim 6 wherein said free ends on said clip arms are curved inwardly to provide a smooth generally arcuate outer surface and wherein said channel on the free edge of said batten strip flanges are generally arcuate in cross section and complementary to and adapted to snap over and be retained by the arcuate surfaces on said clip arms.

8. The wall panel assembly defined in claim 7 wherein said batten strips are supported solely by said mounting clips, each said batten strip extending in outwardly spaced relation to the reinforcing rib over which it is mounted whereby when the wall panel assembly is employed as a roof, water is not siphoned upwardly along said reinforcing rib leg to said crown by capillary action between the reinforcing rib leg outer surface and the batten strip flange inner surface.

9. The wall panel assembly defined in claim 8 wherein said second portion of said mounting clip arms are spaced from said reinforcing rib legs when said batten strips are mounted thereon.

10. A wall panel assembly for an external building roof or wall including a plurality of generally rectangular sheet metal panels each having a plurality of laterally spaced, parallel, outwardly projecting reinforcing rib including one such rib extending adjacent each longitudinal side edge thereof, said panels being disposed in parallel relationship with the reinforcing ribs on adjacent side edges of successive panels overlapping, a plurality of headed fasteners penetrating each said panel along each said reinforcing rib to secure the panels to underlying building structure, a plurality of batten strip mounting clips mounted on each said panel by said fasteners along each said reinforcing rib, and an elongated batten strip mounted on said clips and extending along each said reinforcing rib concealing said headed fasteners and said clips and improving the watertight integrity of the building wall, said reinforcing ribs being integrally formed from the building panel sheet metal and each including a pair of outwardly extending leg portions joined by a central web portion, said mounting clips each including a central body portion having a fastener receiving opening extending therethrough and shaped complementary to the exposed outer surface of the central web, and a pair of arms extending one along each edge of the body portion, said arms each including a portion extending generally along and spaced outwardly from the reinforcing rib leg and terminating in a free end spaced from the building panel and from the reinforcing rib, said batten members each including an elongated generally channel shaped member having a central crown and a pair of integrally formed, generally opposed, spaced flanges, said flanges terminating in an inwardly directed free edge portion forming a channel, said flange free edges being normally spaced apart a distance less than the spacing of said arm free ends and adapted to be snapped thereover whereby said batten strips may be mounted on the clips by asserting a compressive force deflecting the mounting clip arms inwardly to snap into interlocking relationship with the channel on the batten strip flanges.

11. The wall panel assembly defined in claim 10 wherein said panels each include at least one said reinforcing rib intermediate said side edges thereof.

* * * * *